United States Patent [19]

Fuller et al.

[11] 4,119,207

[45] Oct. 10, 1978

[54] MEANS FOR DISPLAYING ARTICLES IN SHINGLED RELATIONSHIP

[76] Inventors: Robert T. Fuller, 1351 Empire St., Anaheim, Calif. 92804; Robert J. Sanders, 2200 E. Oskosh Cir., Anaheim, Calif. 92806

[21] Appl. No.: 733,532

[22] Filed: Oct. 18, 1976

[51] Int. Cl.[2] ..... A47F 5/14

[52] U.S. Cl. ..... 211/45; 211/50; 211/189

[58] Field of Search ..... 211/45, 49 D, 181, 182, 211/50, 52, 55, 106, 189, 195, 200, 201; 40/125 H

[56] References Cited

U.S. PATENT DOCUMENTS

| | | | |
|---|---|---|---|
| D. 162,990 | 4/1951 | Roeder | 211/181 X |
| 1,116,172 | 11/1914 | Turner | 211/181 X |
| 2,793,760 | 5/1957 | Zel et al. | 211/181 X |
| 3,169,812 | 2/1965 | Grönkvist et al. | 211/45 X |
| 3,203,554 | 8/1965 | Pendergrast et al. | 211/49 D |
| 3,329,282 | 7/1967 | Swan et al. | 211/182 X |
| 3,528,558 | 9/1970 | Williams | 211/49 D |
| 3,568,347 | 3/1971 | Sheker | 40/125 H |
| 3,757,443 | 9/1973 | Miller et al. | 40/125 H |
| 3,915,097 | 10/1975 | Young | 211/181 X |
| 3,960,275 | 6/1976 | Haughton et al. | 211/182 |

FOREIGN PATENT DOCUMENTS

| | | | |
|---|---|---|---|
| 791,511 | 8/1968 | Canada | 211/182 |
| 336,686 | 4/1959 | Switzerland | 211/181 |

*Primary Examiner*—Roy D. Frazier
*Assistant Examiner*—Robert W. Gibson, Jr.
*Attorney, Agent, or Firm*—Donald D. Mon

[57] ABSTRACT

A display rack device wherein flat articles such as carpet samples can be displayed in a shingled manner so as to show a portion of a plurality of displays and the major portion of at least the top one of said displays.

11 Claims, 12 Drawing Figures

MEANS FOR DISPLAYING ARTICLES IN SHINGLED RELATIONSHIP

This invention relates to display racks.

In the display of flat articles, especially of carpet samples, a prime objective is to have available in as small a bulk as possible the largest number of samples, preferably exposing at least portions of each of many displays.

Any person who has been to a carpet store and has seen carpet books stacked around on the floor recognizes that a customer faces a physical task if he proposes to examine a substantial number of samples. Furthermore, the individual color samples are likely to be at least partially hidden in the fold of the book. In applicant's copending patent application Ser. No. 597,381 entitled "Display System for Samples" filed July 18, 1975, now U.S. Pat. No. 4,063,648 issued Dec. 20, 1977, one technique has been shown for reducing this labor by mounting the samples to individual boards and then pivotally mounting the boards by their edges, much like the pages of a book. This has proved to be an attractive and satisfactory means for displaying carpet sections, but still has the limitation that like any other book it must be as thick as its pages and is limited to displays of the height of the "pages".

It is an object of this invention to provide means for displaying flat articles such as boards containing carpet selections which can readily be assembled and then displayed in a shingled manner wherein, while many of the individual samples may be shrouded, at least part of each board will be exposed, and can readily be removed for closer and more complete examination. This increases the storage capacity and the effective display of the articles and also makes possible free standing displays of small bulk with large capacity.

A display rack according to this invention comprises a pair of suspension uprights and a support upright. The suspension uprights are laterally spaced apart from one another and are structurally interconnected. Rack members are mounted to the suspension uprights, and are supported at a predetermined angle by the support upright.

According to a preferred but optional feature of the invention, the rack members are sufficiently flexible that, with an initial unflexed length longer than the spacing between the suspension uprights, they can be bent to reduce this spacing and introduced into opening in the suspension uprights, and then released to spring back to the unflexed condition where they will be retained by the suspension uprights.

According to still another preferred but optional feature of the invention, the suspension uprights and the support upright have a hollow core whereby readily to be assembled to adjacent structure.

The above and other features of this invention will be fully understood from the following detailed description and the accompanying drawings in which.

Figure 1:
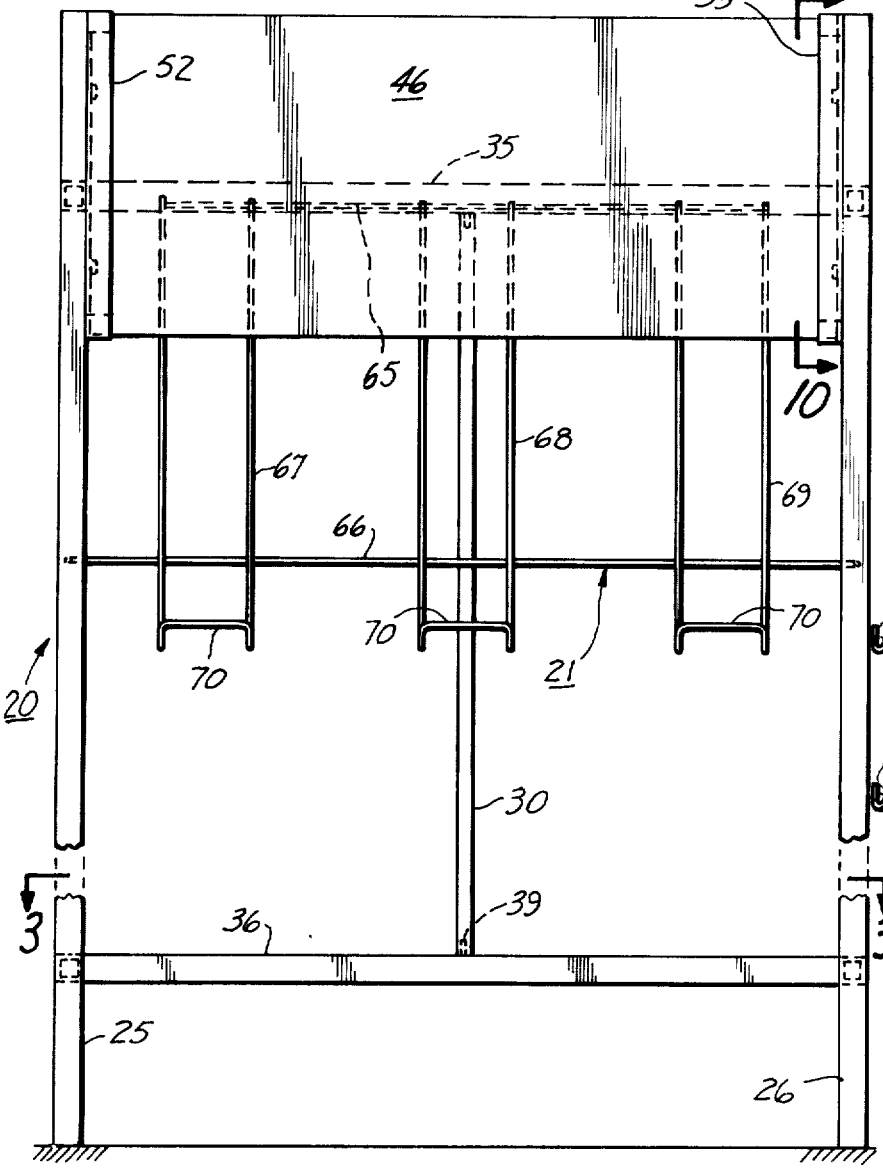
FIG. 1 is a side elevation of the presently preferred embodiment of the invention.
Figure 2:
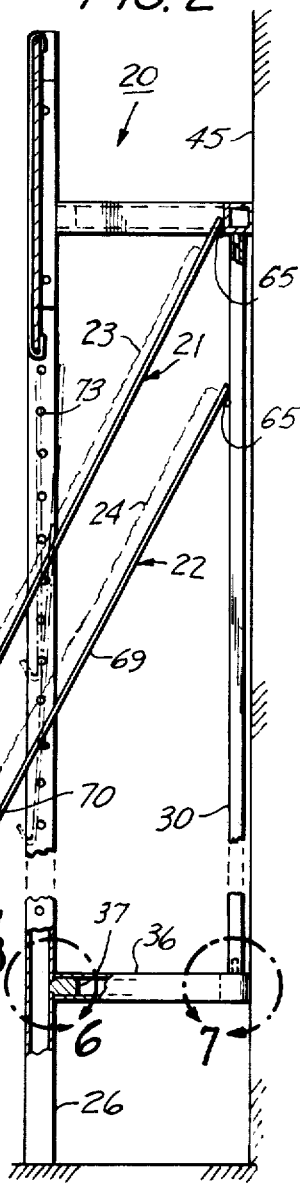
FIG. 2 is a right hand side view of FIG. 1 with a portion of a suspension upright cutaway.
Figure 10:
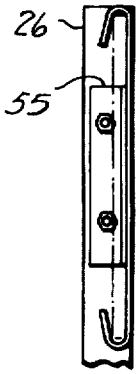
Figure 11:
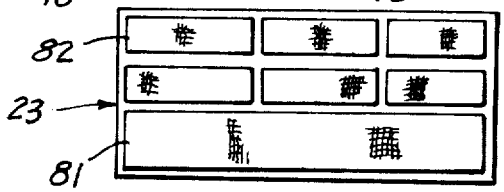
Figure 6:
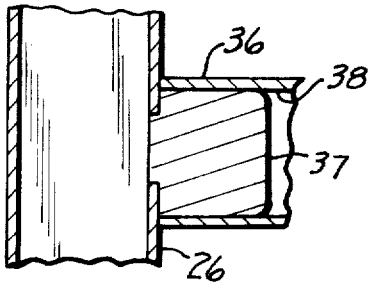
Figure 7:
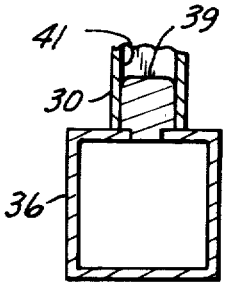
Figure 12:
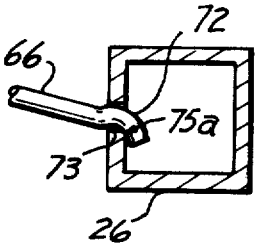
Figure 8:
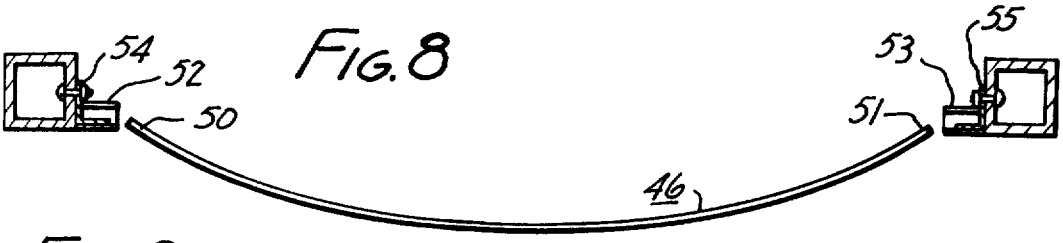
Figure 9:
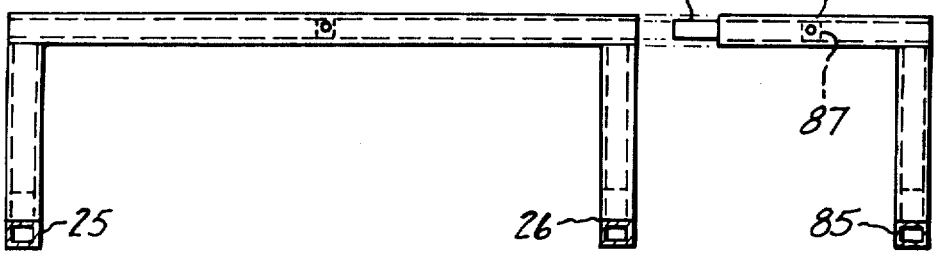

FIGS. 6 and 7 are localized cross-sections taken at regions 6 and 7 respectively in FIG. 2;

FIG. 8 shows a face plate for the display means;

FIG. 9 is a side elevation showing a means for providing a multiplicity of racks;

FIG. 10 shows a detail taken at line 10—10 of FIG. 1;

FIG. 11 is a plan view of a display board for which this display is particularly suited; and FIG. 12 is a fragment showing a feature of the invention.

In FIGS. 1 and 2 there is shown a display device 20 according to the invention. Its purpose is to provide one or more rack members, such as rack members 21, 22, to support display boards 23, 24, or other types of flat articles. It will be noted that these rack members and the articles they support are in shingled array. This is to say that they partially overlap one another as they slope downwardly in a vertical stack.

Figure 3:
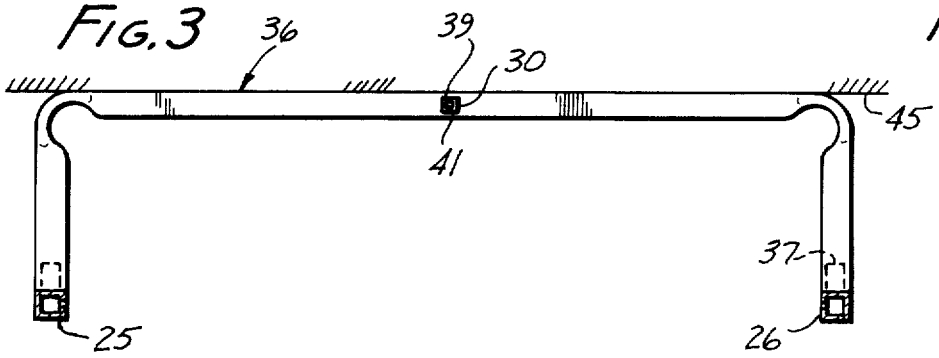
FIG. 3 is a cross-section taken at line 3—3 of FIG. 1.

A pair of suspension uprights 25, 26 is placed vertically at the front of the display device. A support upright 30 is placed in the back. These uprights form a vertically extending array, and are joined together by U-shaped tie members 35, 36 (see FIG. 3). The uprights and tie members are attached to each other by means such as the joints show in FIGS. 6 and 7. In FIG. 6, for example there is shown a square-sectioned connector 37 which is welded or otherwise rigidly fixed, perhaps by threads, to suspension upright 26, and plugged into the end of a square-sectioned core passage 38 in tie member 36. Similarly, a connector 39 is fixed to the bight of the tie member, and projects vertically so as to enter the core passage 41 of support upright 30.

The support upright 30 thereby extends between the two tie members, and joins them together. The upper tie member 35 has a similar connector.

It will be seen that by making the fit tight enough at these joints, a unitary and rigid structural assembly can be formed. The suspension and support uprights and the tie members may conveniently all have square cross-sections although it will be recognized that circular or other cross-sections could be used. However, the square cross-sections will enable square plugs such as connector 37 to be plugged in to the core passages and fit them closely, thereby to provide resistance to torsional movement. This adds to the structural rigidity.

In FIG. 2, a wall 45 is shown. It is apparent that the two tie members can be attached to it by nailing them directly, or by attaching a strap to the wall to bind the tie member to the wall. The device is then completely stable. It is evident that legs (not shown) can depend from the tie members to provide a free standing device. Generally speaking, however, the weight carried by this rack device will be such that side support by the wall of a room will be preferable.

The suspension uprights are intended to rest on the floor although they need not do so. The support upright and the lower tie member do not usually reach the floor, although legs could be provided for this purpose. The construction shown saves considerable material, while still accomplishing the functions of the invention.

Upper portions of the support uprights may project above the tie member so as to provide means for supporting a face plate 46 that can be used to bear advertising messages. The face plate is attached to the suspension uprights by bending it (FIG. 8) and inserting its ends 50, 51 into channels 52, 53, respectively. These channels are attached to suspension uprights 25, 26 by screws threaded into holes in the uprights through flanges 54, 55, respectively. The face plate will be made of Masonite or some other relatively flexible material. It can be attached to the suspension uprights by being flexed as shown in FIG. 10, and, when released, it returns to its flat configuration with ends 50, 51 held in channels 52 and 53. The face plate is accurately aligned by the channel, and when multiple units stand side-by-side, the face plates are in good alignment with one another.

Figure 4:
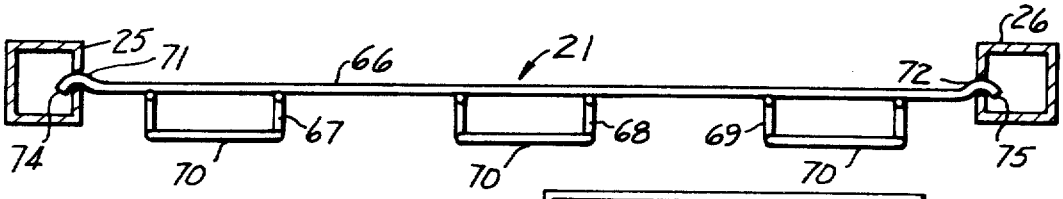
FIGS. 4 and 5 are fragmentary sectional top views showing respectively the unflexed and flexed position of rack members for insertion into the suspension uprights.
Figure 5:
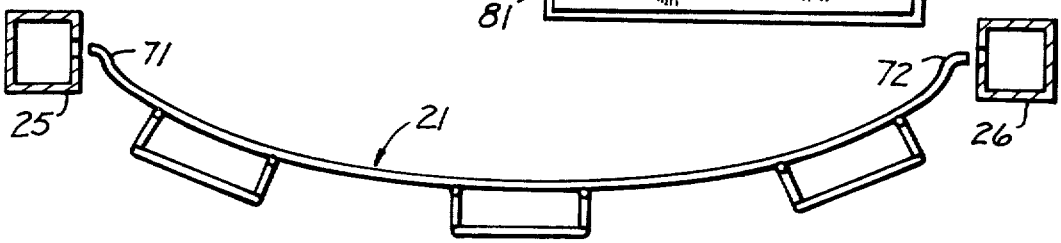

A typical rack member 21 includes an upper cross member 65, a lower cross member 66, and three base members 67, 68, 69. Each base member has a lower hook 70. The base members are conveniently U-shaped, with the bight of the U turned upwardly to form the hook. Such a construction is readily made on a conventional wire bending machine. This array of members, which may be made of relatively strong wire or rod, are spot-welded together as shown. At least the lower cross member should be springily flexible. A convenient technique for mounting the rack to the suspension upright is to provide a pair of bends 71, 72, one at each end of the lower cross member. This is simply a double bend in the material. This cross member can be sprung to the shape of FIG. 5 from that of FIG. 4 and will return thereto when the bending force is released.

The suspension uprights have a plurality of holes 73 spaced along its length for the purpose of receiving the ends 74, 75 of the lower cross members. When they are introduced into these holes, the rack is held centered by the bearing of the inside of the bends on the inside of the suspension uprights (see FIG. 4). Should someone lean on the cross member to bend it reversely, the cross member is held all the more tightly (see FIG. 12), because the effect is to push the bend farther around edge 75*a*.

The upper cross members can rest against the support members to determine the angle of display. The uppermost rack may bear against the top tie member, if desired.

When one faces the display as in FIG. 1, the suspension means are seen laterally spaced from one another. Viewed downwardly as in FIG. 3, the support upright 30 is spaced from the suspension uprights, and is spaced from an imaginary straight line drawn between them by a given distance (i.e., about the length of the shorter arms of tie member 36). As viewed from the side in FIG. 2, the rack members have a width from the cross member which is greater than the given distance. Accordingly, when cross member 66 is attached to the suspension members, at least one of the rack members leans rearwardly and downwardly against the support member. In FIG. 2, the upper rack member bears against the upper tie member, but this is merely a matter of convenience. Thus, the rack members can be attached and detached by manipulations at the front of the display, without any need to try to engage anything in holes at the rear of the display.

It will now be seen that any number of racks may be placed by inserting their ends into correct holes 73 on the suspension uprights. Thereafter the articles may simply be laid atop the base members and supported by the hook. For example in FIG. 11 there is shown a display board 23 with a plurality of carpet samples 81, 82 on its face. Carpet sample 81 may be a large sample which may extend for substantially the full width of the board, and project below the bottom edge of the display board just above it so as to always be visible. It can be an example of the remaining smaller carpet samples 82, which will usually show the other colors in the same fabric line. This enables a person to see a major sample of the entire line on the respective board and to have access to the entire board by removing the board from its rack, which is simple. The boards may be made of any suitable material such as fiberboard or cardboard.

The construction shown is such that it can readily be multiplied in length. For example, FIG. 9 shows suspension uprights 25, 26 connected as aforesaid with another suspension upright 85 joined to the tie members by means of additional L-shaped tie members 86. Only one is shown—they will be provided in pairs, as in the original assembly. A support member 87 will extend between tie members 86. Instead of the bent construction shown in FIG. 3, the tie members will preferably be welded to provide square-sectioned openings for connectors such as connector 88, thereby to make a suitably rigid assembly. The assembly may be extended to any desired length by providing the appropriate member of additional parts.

As another means for multiplying the length, the tie members can be made with a single back length, and three or more portions extending toward respective support uprights, much like a comb, thereby to connect with a plurality of said uprights from a unitary multiple-length tie member.

The construction shown can readily be assembled, can be taken apart, and shipped in a very small bulk. It can be made of inexpensive extruded or rolled tubing. It makes available for display and examination large surface areas compared to the area occupied on the floor or on the wall of the display room. The racks can conveniently be made of rod or wire. Other materials of construction can, of course, be used instead, and still fall within the scope of this invention.

The reversal of parts, for example, pegs on the suspension members and holes in the ends of the lower cross-member, instead of the arrangement shown, the usage of more than one support member, and the support of the rack from the upper rather than from the lower cross-member, are all within the scope of this invention.

This invention is not to be limited by the embodiments shown in the drawings or described in the description which are given by way of example and not of limitation, but only in accordance with the scope of the appended claims.

We claim:

1. A display device for holding flat articles in shingled relationship comprising:

a pair of suspension uprights, each suspension upright having a plurality of spaced apart holes, holes in each of the said suspension uprights being at the same elevation and facing one another in pairs;

a support upright;

a tie member joining said uprights in a vertical array, said suspension uprights being laterally spaced apart from one another, and said support upright being spaced from both of said suspension uprights and spaced to the rear of them by a given distance from a line drawn between them; and a plurality of rack members each comprising a base member, a hook on said rack member adjacent to the lower edge thereof to restrain an article resting on the rack member from sliding off, and a stiffly flexible cross member, said base member, hook and cross member being joined together to form an integral structure, said cross member being attachable to the suspension uprights by being flexed and its ends inserted into a pair of said holes, one in each of said suspension uprights, each said cross member including a pair of bends, one reverse to the other, at each end permitting the entry of the end of the cross member into a hole in the suspension upright when flexed in one direction, and inhibiting its removal when the cross member is unflexed or is flexed in the opposite direction, the rack member having a width greater than said given distance, whereby at least one of said rack members, when its cross member is attached to the suspension uprights, leans in abutment rearwardly and downwardly against the support upright and being freely pivotable without engagement to the support upright except in said leaning abutment.

2. A display device according to claim 1 in which the uprights and tie member are interconnected by plug-and-socket joinders.

3. A display device according to claim 2 in which the joinders are non-circularly sectioned.

4. A display device according to claim 3 in which the joinders are rectangularly-sectioned.

5. A display device according to claim 1 in which the tie member is U-shaped.

6. A display device according to claim 1 in which a face plate is connected to and extends between the suspension members.

7. A display device according to claim 6 in which the suspension uprights include an open-ended channel to receive said face plate, said face plate being springily flexible for insertion into a channel on each of two adjacent suspension uprights, said face plate springing back to an unflexed condition for retention in said channels.

8. A display device according to claim 1 in combination with a plurality of said articles.

9. A display device according to claim 1 in which an L-shaped tie member is attachable to said first-named tie members for extension of the display device, said L-shaped tie member being adapted to be attached to another suspension upright and to another support upright.

10. A display device according to claim 9 including said other suspension upright and support upright.

11. A display device according to claim 1 in which a second cross member is spaced from the first cross member and forms an integral part of the rack member.

* * * * *